US007420332B2

(12) United States Patent
Kato

(10) Patent No.: US 7,420,332 B2
(45) Date of Patent: Sep. 2, 2008

(54) LED LIGHTING DEVICE

(75) Inventor: Akira Kato, Takatsuki (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 82 days.

(21) Appl. No.: 11/616,909

(22) Filed: Dec. 28, 2006

(65) Prior Publication Data

US 2007/0115661 A1 May 24, 2007

Related U.S. Application Data

(63) Continuation of application No. PCT/JP2006/300481, filed on Jan. 17, 2006.

(30) Foreign Application Priority Data

Feb. 25, 2005 (JP) ..... 2005-051108

(51) Int. Cl.
*H05B 37/00* (2006.01)

(52) U.S. Cl. ..... 315/185 S; 315/200 A; 315/312; 315/323; 315/325; 362/806; 362/800; 362/802

(58) Field of Classification Search ..... 315/185 S, 315/200 A, 312, 323–325; 362/806, 812, 362/802, 800, 801
See application file for complete search history.

(56) References Cited

U.S. PATENT DOCUMENTS 6,069,452 A 5/2000 Rossner
6,194,839 B1 2/2001 Chang
6,249,088 B1 6/2001 Chang
6,636,027 B1 10/2003 Nerone
2003/0122502 A1 7/2003 Clauberg et al.
2005/0168156 A1* 8/2005 Li et al. ..... 315/185 R
2007/0096661 A1* 5/2007 Allen ..... 315/207
2007/0273299 A1* 11/2007 Miskin et al. ..... 315/250

FOREIGN PATENT DOCUMENTS

JP 2001-524249 A 11/2001

(Continued)

OTHER PUBLICATIONS

Official communication for PCT Application No. PCT/JP2006/300481 mailed on Feb. 14, 2006.

*Primary Examiner*—Tuyet Vo
(74) *Attorney, Agent, or Firm*—Keating & Bennett, LLP

(57) ABSTRACT

A first LED array including a first capacitor, LED blocks, and a second capacitor that are connected in series with each other, a second LED array having a similar configuration to the first LED array, and a third LED array having a similar configuration to the first LED array are connected in parallel with each other and are connected to an AC power supply AC. Each of the LED blocks includes a first series circuit and a second series circuit that are connected in parallel with each other. The first series circuit includes two LEDs that are connected in series with each other in the same direction. The second series circuit includes two LEDs that are connected in series with each other in an identical direction opposite to the direction of the LEDs in the first series circuit. A connection point between the two LEDs in the second series circuit in one of the adjacent LED blocks is coupled to a connection point between the two LEDs in the first series circuit in the other one of the adjacent LED blocks.

6 Claims, 3 Drawing Sheets

FOREIGN PATENT DOCUMENTS

| | | | |
|---|---|---|---|
| JP | 2003-513420 | A | 4/2003 |
| JP | 2003-513453 | A | 4/2003 |
| JP | 2003-332625 | A | 11/2003 |
| JP | 2004-512697 | A | 4/2004 |
| WO | 02/35889 | A1 | 5/2002 |
| WO | 03/056878 | A1 | 7/2003 |

* cited by examiner

LED LIGHTING DEVICE

BACKGROUND OF THE INVENTION

1. Field of the Invention

The present invention relates to LED lighting devices that are driven by AC power supplies, and more particularly, to an LED lighting device that is directly driven by a commercial AC power supply.

2. Description of the Related Art

LEDs (light-emitting diodes) are known as having high light-emission efficiency. In recent years, energy savings, commercialization of high-intensity white light-emitting diodes, and price reductions have been advanced. As a result, LEDs can now be used for the purpose of lighting.

PCT Japanese Translation Patent Publication No. 2003-513453 (Patent Document 1) describes an LED used for the purpose of lighting. In Patent Document 1, a plurality of LEDs are arranged in series and in parallel to define a lattice shape, and the plurality of LEDs are driven by DC voltages. In addition, even if a failure occurs in one of the plurality of LEDs, the other LEDs are not turned off.

However, as a lighting device, it is preferable to use a commercial AC power supply. In this case, in terms of energy efficiency, it is preferable that AC voltages be directly applied to the LEDs to turn the LEDs on without converting the AC voltages into DC voltages.

Japanese Unexamined Patent Application Publication No. 2003-332625 (Patent Document 2) describes a circuit for turning on LEDs using AC voltages. Patent Document 2 discloses a technology in which an LED and a diode are connected in parallel with each other such that they have polarities opposite to each other, and in which an AC voltage is applied through a capacitor to the parallel circuit. This capacitor does not have a polarity, and a forward current is applied to the LED in only a half period of the AC voltage to turn on the LED. In this case, even if a power supply having a voltage higher than a withstand voltage of the LED, such as a commercial AC power supply, is used, a voltage drop caused by the capacitor prevents a failure in the LED.

The diode is connected in parallel with the LED such that the diode is disposed in a direction opposite to the LED. This is because a rectification of the circuit can be prevented by causing a current to flow to the diode in a half period in which the LED is not turned on. If the diode is not connected, the rectification performed by the LED causes an electric charge to be stored in the capacitor. Thus, since a forward voltage is not applied to the LED, the LED is not turned on.

Instead of the diode, an LED may be used.

For lighting LEDs using a DC power supply, a configuration in which LEDs are arranged in an array as described in Patent Document 1 is taught. With this configuration, even if one of the LEDs is disconnected and turned off, the other LEDs are not turned off. However, in the case of Patent Document 1, an AC power supply cannot be directly used. In addition, when a DC voltage obtained by simply rectifying and smoothing a commercial AC power supply is used, the voltage must be reduced to an appropriate voltage. However, for example, causing a voltage to be reduced across a resistor is not practical in terms of efficiency. In contrast, when a high voltage obtained by rectifying and smoothing a commercial AC power supply is directly applied to LEDs, a significantly large number of serially connected LEDs are required. This is also not practical. The above-mentioned problems can be solved by separately providing a high-efficiency DC power supply that emits a low voltage. However, an unwanted circuit (a DC power supply) is required, and this causes problems in terms of size and price.

When a commercial AC power supply is used as described in Patent Document 2, the above-mentioned problems do not occur. However, in Patent Document 2, a circuit for turning on an LED is merely presented. That is, in Patent Document 2, a required mechanism for turning on a plurality of LEDs for lighting or the configuration described in Patent Document 1 in which a failure occurring in one of a plurality of LEDs does not affect the other LEDs is not taught. A diode may be replaced with an LED in the configuration described in Patent Document 2. In this case, however, if one of the LEDs is disconnected and turned off, the other one of the LEDs is also turned off.

Furthermore, for white LEDs, failures due to short circuits may occur more frequently than failures due to disconnections. None of the technologies described in the patent documents discussed above addresses this problem.

SUMMARY OF THE INVENTION

In order to overcome the above-described problems, an LED lighting device according to preferred embodiments of the present invention includes a simple circuit configuration in which a plurality of LEDs are directly driven and turned on by an AC power supply and in which a failure occurring in one LED due to disconnection or short circuit does not substantially effect the other LEDs.

An LED lighting device according to preferred embodiments of the present invention includes n number of LED arrays that are connected in parallel with each other and that have an identical internal configuration, where n is an integer of two or more. Each of the LED arrays includes at least one capacitor and at least one LED block that are sequentially connected in series with each other. Each of the at least one LED block includes a first series circuit and a second series circuit that are connected in parallel with each other. The first series circuit includes first and second LEDs that are connected in series with each other in the same direction. The second series circuit includes third and fourth LEDs that are connected in series with each other in a direction that is opposite to the direction of the LEDs in the first series circuit. In LED blocks in a sequential order in the ith LED array and the i+1th LED array, a connection point between the third and fourth LEDs in the ith LED array is coupled to a connection point between the first and second LEDs in the i+1th LED array, where i is an integer between 1 and n, and where the i+1th LED array is the first LED array when i is n.

In addition, in the LED lighting device according to preferred embodiments of the present invention, the plurality of LED arrays preferably may be arranged in a substantially cylindrical shape.

Furthermore, the LED lighting device according to preferred embodiments of the present invention may further include a full-wave rectifying circuit connected in series with the plurality of LED arrays that are connected in parallel with each other.

In the LED lighting device according to preferred embodiments of the present invention, an AC power supply, in particular, a commercial AC power supply is directly applied to a plurality of LEDs to turn the LEDs on. In addition, even if one of the plurality of LEDs are turned off due to disconnection or short circuit, only an insubstantial adverse influence is exerted on the other LEDs, thus preventing the other LEDs from being turned off.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

First Preferred Embodiment

Figure 1:
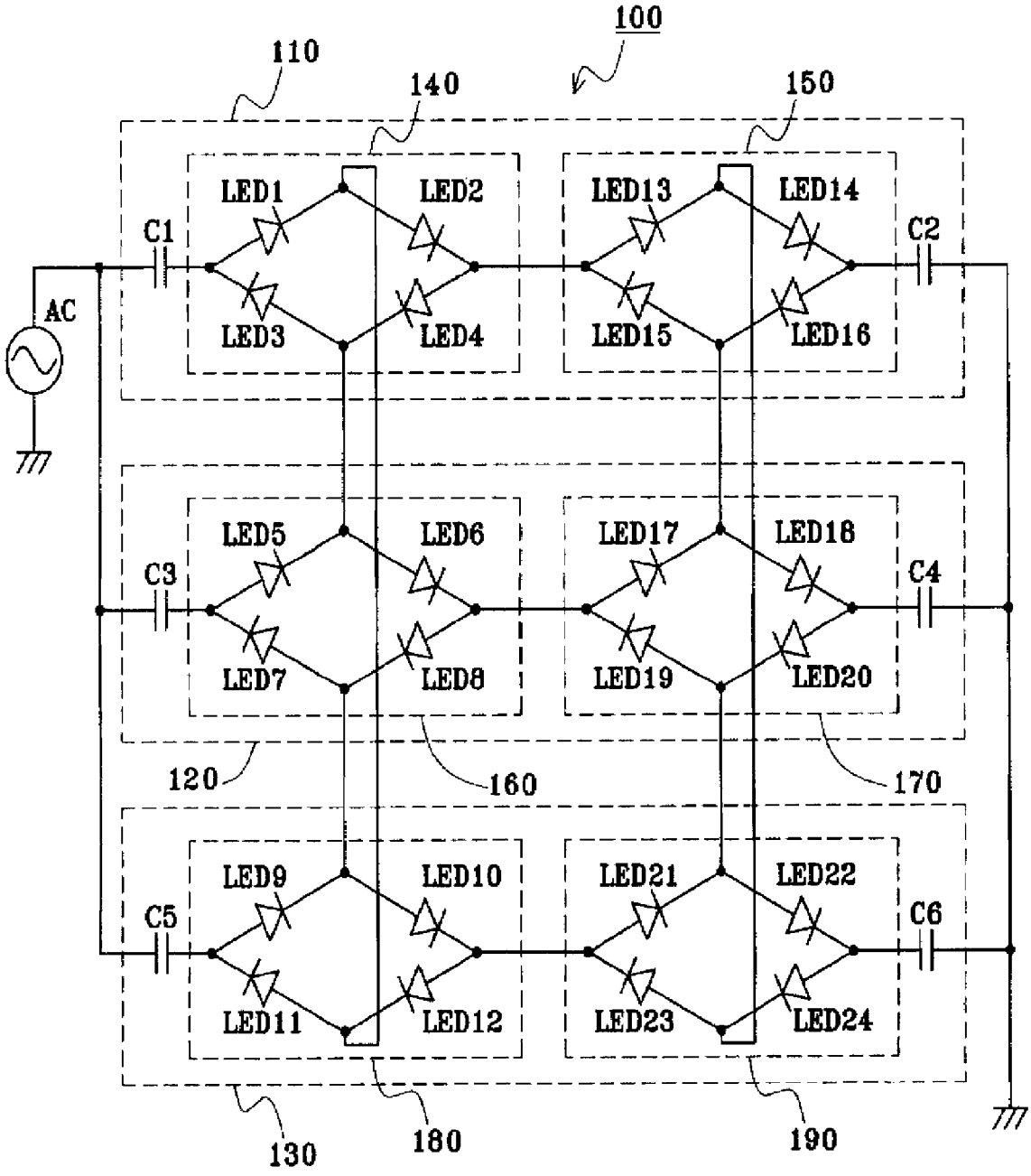
FIG. 1 is a circuit diagram showing an LED lighting device according to a preferred embodiment of the present invention.

FIG. 1 shows a circuit of an LED lighting device according to a first preferred embodiment of the present invention. As shown in FIG. 1, an LED lighting device 100 includes three LED arrays 110, 120, and 130, each having two terminals. The LED arrays 110, 120, and 130 are referred to as first, second, and third LED arrays, respectively. The LED arrays 110, 120, and 130 are connected in parallel with each other. Both ends of the LED arrays 110, 120, and 130 are connected to an AC power supply AC.

The LED array 110 preferably includes four component parts, that is, a capacitor C1, LED blocks 140 and 150 (referred to as first and second LED blocks, respectively), and a capacitor C2. The capacitor C1, the LED blocks 140 and 150, and the capacitor C2 are connected in series between two terminals of the LED array 110 in that order. The LED array 120 preferably includes four component parts, that is, a capacitor C3, LED blocks 160 and 170 (referred to as first and second LED blocks, respectively), and a capacitor C4. The capacitor C3, the LED blocks 160 and 170, and the capacitor C4 are connected in series between two terminals of the LED array 120 in that order. The LED array 130 preferably includes four component parts, that is, a capacitor C5, LED blocks 180 and 190 (referred to as first and second LED blocks, respectively), and a capacitor C6. The capacitor C5, the LED blocks 180 and 190, and the capacitor C6 are connected in series between two terminals of the LED array 130 in that order. Each of the capacitors C1, C2, C3, C4, C5, and C6 does not have a polarity.

The LED block 140, which is a component part of the LED array 110, includes two series circuits each including two LEDs connected in series to each other with the same direction. The two series circuits are connected in parallel with each other. One of the two series circuits is a first series circuit (a series circuit including an LED 1 and an LED 2) and the other one of the two series circuits is a second series circuit (a series circuit including an LED 3 and an LED 4). The LEDs in the first series circuit are disposed in a direction opposite to the direction in which the LEDs in the second series circuit are disposed. The other LED block 150 in the LED array 110 is configured similarly to the LED block 140. The LED block 150 includes a first series circuit (a series circuit including an LED 13 and an LED 14) and a second series circuit (a series circuit including an LED 15 and an LED 16).

The LED block 160, which is a component part of the LED array 120, includes two series circuits each including two LEDs connected in series with each other in the same direction. The two series circuits are connected in parallel with each other. One of the two series circuits is a first series circuit (a series circuit including an LED 5 and an LED 6) and the other one of the two series circuits is a second series circuit (a series circuit including an LED 7 and an LED 8). The LEDs in the first series circuit are disposed in a direction opposite to the direction in which the LEDs in the second series circuit are disposed. The other LED block 170 in the LED array 120 is configured similarly to the LED block 160. The LED block 170 includes a first series circuit (a series circuit including an LED 17 and an LED 18) and a second series circuit (a series circuit including an LED 19 and an LED 20).

The LED block 180, which is a component part of the LED array 130, includes two series circuits each including two LEDs connected in series with each other in the same direction. The two series circuits are connected in parallel with each other. One of the two series circuits is a first series circuit (a series circuit including an LED 9 and an LED 10) and the other one of the two series circuits is a second series circuit (a series circuit including an LED 11 and an LED 12). The LEDs in the first series circuit are disposed in a direction opposite to the direction in which the LEDs in the second series circuit are disposed. The other LED block 190 in the LED array 130 is configured similarly to the LED block 180. The LED block 190 includes a first series circuit (a series circuit including an LED 21 and an LED 22) and a second series circuit (a series circuit including an LED 23 and an LED 24).

The second series circuit of the LED block 140 (the first LED block in the LED array 110), which is disposed subsequent to the capacitor C1 and is the second component part of the LED array 110, is coupled to the first series circuit of the LED block 160 (the first LED block in the LED array 120), which is disposed subsequent to the capacitor C3 and is the second component part of the LED array 120. More specifically, a connection point between the third LED 3 and the fourth LED 4 of the second series circuit in the LED block 140 is coupled to a connection point between the first LED 5 and the second LED 6 of the first series circuit in the LED block 160. That is, the connection point between the third and fourth LEDs in the first LED array is coupled to the connection point between the first and second LEDs in the second LED array.

The second series circuit of the LED block 160 in the LED array 120 is coupled to the first series circuit of the LED block 180 (the first LED block in the LED array 130), which is disposed subsequent to the capacitor C5 and is the second component part of the LED array 130. More specifically, a connection point between the third LED 7 and the fourth LED 8 of the second series circuit in the LED block 160 is coupled to a connection point between the first LED 9 and the second LED 10 of the first series circuit in the LED block 180. That is, the connection point between the third and fourth LEDs in the second LED array is coupled to the connection point between the first and second LEDs in the third LED array.

The second series circuit of the LED block 180 in the LED array 130 is coupled to the first series circuit of the LED block 140 in the LED array 110. More specifically, a connection point between the third LED 11 and the fourth LED 12 of the second series circuit in the LED block 180 is coupled to a connection point between the first LED 1 and the second LED 2 of the first series circuit in the LED block 140. That is, the connection point between the third and fourth LEDs in the third LED array is coupled to the connection point between the first and second LEDs in the first (3+1th) LED array.

That is, the connection point between the third and fourth LEDs in the ith LED array is coupled to the connection point between the first and second LEDs in the i+1th LED array. Here, i represents an integer between 1 and 3. When i is 3, the i+1th LED array represents the first LED array.

Similarly, for the LED block 150 (the second LED block in the LED array 110), which is disposed subsequent to the LED block 140 and is the third component part of the LED array 110, the LED block 170 (the second LED block in the LED array 120), which is disposed subsequent to the LED block 160 and is the third component part of the LED array 120, and the LED block 190 (the second LED block in the LED array 130), which is disposed subsequent to the LED block 180 and is the third component part of the LED array 130, the connection point between the third and fourth LEDs in the ith LED array is coupled to the connection point between the first and second LEDs in the i+1th LED array.

An operation of the LED lighting device 100 configured as described above will be described.

Each of the LED arrays is described below. The voltage of the AC power supply AC is directly applied to each of the LED array 110, the LED array 120, and the LED array 130. A commercial AC power supply may be used as the AC power supply AC. Alternatively, a voltage that is reduced by a transformer may be used.

The AC voltage of the AC power supply AC applied to the LED array 110 is applied to each of the capacitor C1, the LED block 140, the LED block 150, and the capacitor C2. Most of the voltage is applied to the capacitors C1 and C2, and a voltage of as small as several V is applied to each of the LED block 140 and the LED block 150. In other words, the capacitances of the capacitors C1 and C2 are set such that a voltage of about several V is to be applied to each of the LED block 140 and the LED block 150. For example, for the LED lighting device 100, a voltage of AC about 50 Hz and about 100 V (283 Vp-p) is used as a commercial power supply, and four LEDs are connected in series. When lighting conditions for each of the LEDs are about 3.6 V and about 500 mA, the total voltage applied to the two LED blocks is about 7.2 V, for example. In addition, the current flowing to the capacitor C1, the capacitor C2, and each of the LED blocks is about 2 A, for example. When the capacitance of each of the capacitors C1 and C2 is about 46 μF, the impedance of each of the capacitors is about 68.95 Ω (that is, at total of about 137.9 Ω), thus achieving a voltage drop of about 275.8 V, for example. The LED array 120 and the LED array 130 preferably have the same configuration as the LED array 110.

Each of the LED blocks will now be described. An AC voltage is applied to the LED block 140 in the LED array 110. During the period in which the AC voltage is a forward voltage with respect to the LEDs (the LED 1 and the LED 2) in the first series circuit, a current flows to the LEDs to turn the LEDs on. In contrast, during the period in which the AC voltage is a forward voltage with respect to the LEDs (the LED 3 and the LED 4) in the second series circuit, a current flows to the LEDs to turn the LEDs on. In the LED block 150, which is the other LED block in the LED array 110, a current flows in a similar manner, and corresponding LEDs to which the current flows are turned on during a corresponding period.

In each of the LED block 160 and the LED block 170 in the LED array 120, a current flows in a similar manner, and corresponding LEDs to which the current flows are turned on during a corresponding period. In addition, in each of the LED block 180 and the LED block 190 in the LED array 130, a current flows in a similar manner, and corresponding LEDs to which the current flows are turned on during a corresponding period.

A coupled portion between LED arrays will now be described. The connection point between the LED 3 and the LED 4 in the LED block 140 is coupled to the connection point between the LED 5 and the LED 6 in the LED block 160. When a forward voltage is applied to the LED 3 and the LED 4, a reverse voltage is applied to the LED 5 and the LED 6. Thus, a current does not flow in the coupled point from one LED block to the other LED block. That is, this state is equivalent to a state in which the LED blocks are not coupled to each other.

The connection point between the LED 7 and the LED 8 in the LED block 160 is coupled to the connection point between the LED 9 and the LED 10 in the LED block 180. In addition, the connection point between the LED 11 and the LED 12 in the LED block 180 is coupled to the connection point between the LED 1 and the LED 2 in the LED block 140. In each of these coupled points, a current does not flow from one LED block to the other LED block. That is, this state is equivalent to a state in which the LED blocks are not coupled to each other.

Similarly, for coupling of the LED block 150 in the LED array 110, coupling of the LED block 170 in the LED array 120, coupling of the LED block 190 in the LED array 130, a current does not flow in a coupled point from one LED block to the other LED block.

A case where the LED 1 included in the LED array 110 is disconnected will now be described. In this case, even during a period in which an AC voltage is a forward voltage with respect to the LED 1 (hereinafter, a state in which a forward voltage is applied to an LED in the first series circuit is referred to as a state in which an AC voltage is applied in a forward direction), a current does not flow to the LED 1. Thus, when the AC voltage is applied in the forward direction, a current does not flow to the capacitor C1, which is connected in series with the LED 1. When the AC voltage is applied in the reverse direction, a current flows to the capacitor C1 via the LED 3 immediately after the disconnection of the LED 1. However, since an electric charge is quickly stored on the capacitor C1 due to a rectification of the LED 3, application of a forward voltage to the LED 3 stops and the LED 3 is turned off. As described above, when an LED that is directly connected to a capacitor is disconnected, another LED that is directly connected to the capacitor is turned off. The capacitor in which an electric charge is stored due to a rectification (in this case, the capacitor C1) does not function as an impedance element for a voltage drop.

Concerning a current flowing to the LED 2, a phenomenon occurs in which when an AC voltage is applied in the forward direction, a portion of a current flowing to the LED 10 flows into the LED 2 through the LED 12 and the coupled point. Thus, the LED 2 is not turned off and remains turned on.

Concerning a current flowing to the LED 4 when an AC voltage is applied in the reverse direction, a phenomenon occurs in which when the LED 1 is disconnected and the LED 3 is not electrically connected, the current flowing to the LED 4 flows into the LED 8 through the coupled point and the LED 6 in the LED array 120. Thus, the LED 4 is not turned off and remains turned on.

Due to the currents flowing to the LED 2 and the LED 4 when the AC voltage is applied in the forward direction and in the reverse direction, each of the LEDs in the LED block 150, which is adjacent to the LED block 140, is not turned off. That is, even if the LED 1 is disconnected, only two LEDs, that is, the LED 1 and the LED 3, are turned off. Similarly, when the LED 3, 5, 7, 9, or 11 is disconnected, only two LEDs are turned off. Moreover, similarly, when the LED 14, 16, 18, 20, 22, or 24 directly connected to the capacitor C2, C4, or C6 is disconnected in the LED block 150, 170, or 190, only two LEDs are turned off.

A case where the LED 2 in the LED array 110 is disconnected will now be described. In this case, during a period in which an AC voltage is applied in the forward direction, a current does not flow to the LED 2. However, when the LED 2 is disconnected, a phenomenon occurs in which a current flowing to the LED 1 flows into the LED 9 through the coupled point and the LED 11 in the LED array 130. Thus, during the period in which the AC voltage is applied in the forward direction, the LED 1 is not turned off.

When no current flows to the LED 2, no current flows into the adjacent LED block 150 through the LED 2. However, a phenomenon occurs in which a portion of a current flowing to the LED 17 in the LED array 120 flows into the LED 13 through the coupled point and the LED 15. In addition, a phenomenon occurs in which a portion of a current flowing to the LED 22 in the LED array 130 flows into the LED 14 through the LED 24 and the coupled point. Thus, even if no current flows into the LED block 150 through the LED 2 during the period in which the AC voltage is applied in the forward direction, each of the LED 13 and the LED 14 is not turned off.

During the period in which the AC voltage is applied in the reverse direction, original channels through which currents flow to the LED 16, the LED 15, the LED 4, and the LED 3 exist. Thus, each of the LED 3, the LED 4, the LED 15, and the LED 16 is not turned off.

As described above, when the LED 2 is disconnected, only the LED 2 is turned off and the other LEDs are not turned off. Similarly, when the LED 4, 6, 8, 10, or 12 is disconnected, only the corresponding LED is turned off. Furthermore, similarly, when the LED 13, 15, 17, 19, 21, or 23 is disconnected in the LED block 150, 170 or 190, only the corresponding LED is turned off.

As described above, in the LED lighting device 100, turning on is achieved by directly applying an AC power supply. Moreover, even if an LED is disconnected and turned off, the influence of the turning off of the LED is exerted only on the LED itself or another LED. Thus, the other LEDs are prevented from being turned off and remain turned on.

In addition, a plurality of LEDs are substantially connected in series with each other in the LED lighting device 100. The amounts of forward voltage drops are different among the LEDs. Thus, if all the LEDs are connected in parallel with each other, a difference in the amount of current may cause a variation in brightness. However, when a plurality of LEDs are connected in series with each other, the amounts of forward voltage drops are averaged. Thus, the variation in the amount of flowing currents is reduced. This advantage increases as the number of LED blocks connected in series with each other in an LED array increases.

As described above, in the LED lighting device 100, when an LED is disconnected in an LED array, a channel for a current to flow through an adjacent LED array is provided. Thus, an adverse influence of no current flowing to the disconnected LED is prevented from being exerted over a wide area.

A case where the LED 1 is short-circuited will now be described. In this case, all the channels for currents flowing through LEDs including a channel for a current flowing through the LED 1 are maintained. Thus, only the LED 1 is turned off, and the other LEDs are not turned off. Similarly, when the LED 2 is short-circuited, all the channels for currents flowing through the LEDs including a channel for a current flowing through the LED 2 are maintained. Thus, only the LED 2 is turned off, and the other LEDs are not turned off. Similarly, when another LED is short-circuited, only the short-circuited LED is turned off.

As described above, in the LED lighting device 100, even if an LED is short-circuited and turned off, the influence caused by the tuning off of the short-circuited LED is exerted only on the short-circuited LED itself. Thus, the other LEDs are prevented from being turned off.

As described above, in the LED lighting device 100 according to preferred embodiments of the present invention, for LED blocks in the same sequential order in the ith LED array and the i+1th LED array (when the number of LED arrays is 3, i is an integer between 1 and 3, and when i is 3, the i+1th LED array is the first LED array), a connection point between the third and fourth LEDs in the ith LED array is coupled to a connection point between the first and second LEDs in the i+1th LED array. Thus, a current channel is provided through the coupled LED arrays. Therefore, even if an LED is turned off due to disconnection or short circuiting, turning off of the other LEDs is effectively prevented.

In the LED lighting device 100, three LED arrays are connected in parallel with each other. However, two or more LED arrays may be connected in parallel with each other.

In addition, in each of the LED arrays 110, 120, and 130, two capacitors and two LED blocks are connected in series with each other. However, an LED block may be provided in an LED array. Alternatively, three or more LED blocks may be connected in series with each other in an LED array. In addition, at least one capacitor may be connected in series with an LED block. For example, if a plurality of LED blocks are connected in series with each other, a capacitor may be connected between two LED blocks. However, it is preferable that capacitors be connected to both ends or one end of a plurality of LED blocks connected in series with each other.

Second Preferred Embodiment

Figure 2:
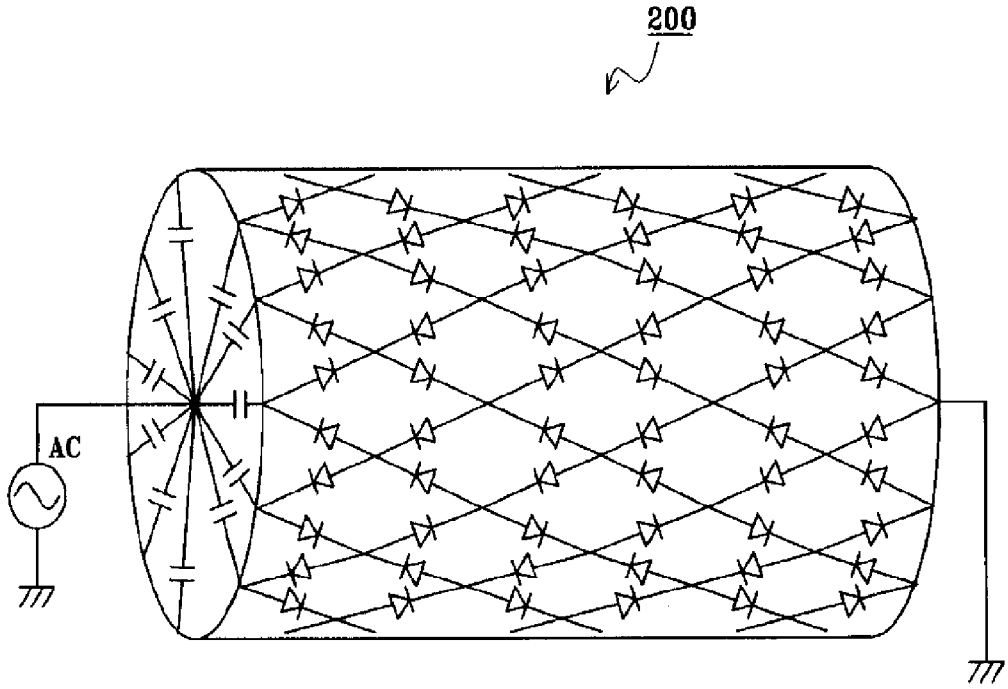
FIG. 2 is a circuit diagram showing an LED lighting device according to another preferred embodiment of the present invention.

FIG. 2 is a schematic diagram showing a circuit of an LED lighting device according to a second preferred embodiment of the present invention. In an LED lighting device 200 shown in FIG. 2, eleven LED arrays are arranged in three dimensions and preferably have a substantially cylindrical shape.

Each of the LED arrays preferably includes capacitors disposed in both ends of the LED array and three LED blocks. The capacitors and the LED blocks are connected in series with each other. A diamond-shaped portion including four LEDs is an LED block.

Each of the LED blocks is preferably configured similarly to each of the LED blocks in the LED lighting device 100 shown in FIG. 1. A connection point between the third and fourth LEDs of an LED block in a sequential order in an LED array is coupled to a connection point between the first and second LEDs of an LED block in the same sequential order in an adjacent LED array, that is, in the next LED array.

As described above, in the LED lighting device 200, by sequentially coupling LED blocks in the same sequential order in LED arrays that are adjacent to each other, a plurality of LED arrays can be arranged in a substantially cylindrical shape. When the LED blocks are arranged in two dimensions, three-dimensional wiring is required for coupling LED blocks at both ends in a parallel direction of the LED arrays. However, when a plurality of LED arrays are arranged in a substantially cylindrical shape, as in the LED lighting device 200, three-dimensional wiring is not required for a substantially cylindrical surface. Thus, a wiring defect is less likely to occur, and a location at which a wiring defect occurs can be easily found. Moreover, as easily imagined from the fact that this substantially cylindrical shape is similar to the shape of a normal fluorescent lamp, the LED lighting device can be used as a replacement for a fluorescent lamp.

Third Preferred Embodiment

Figure 3:
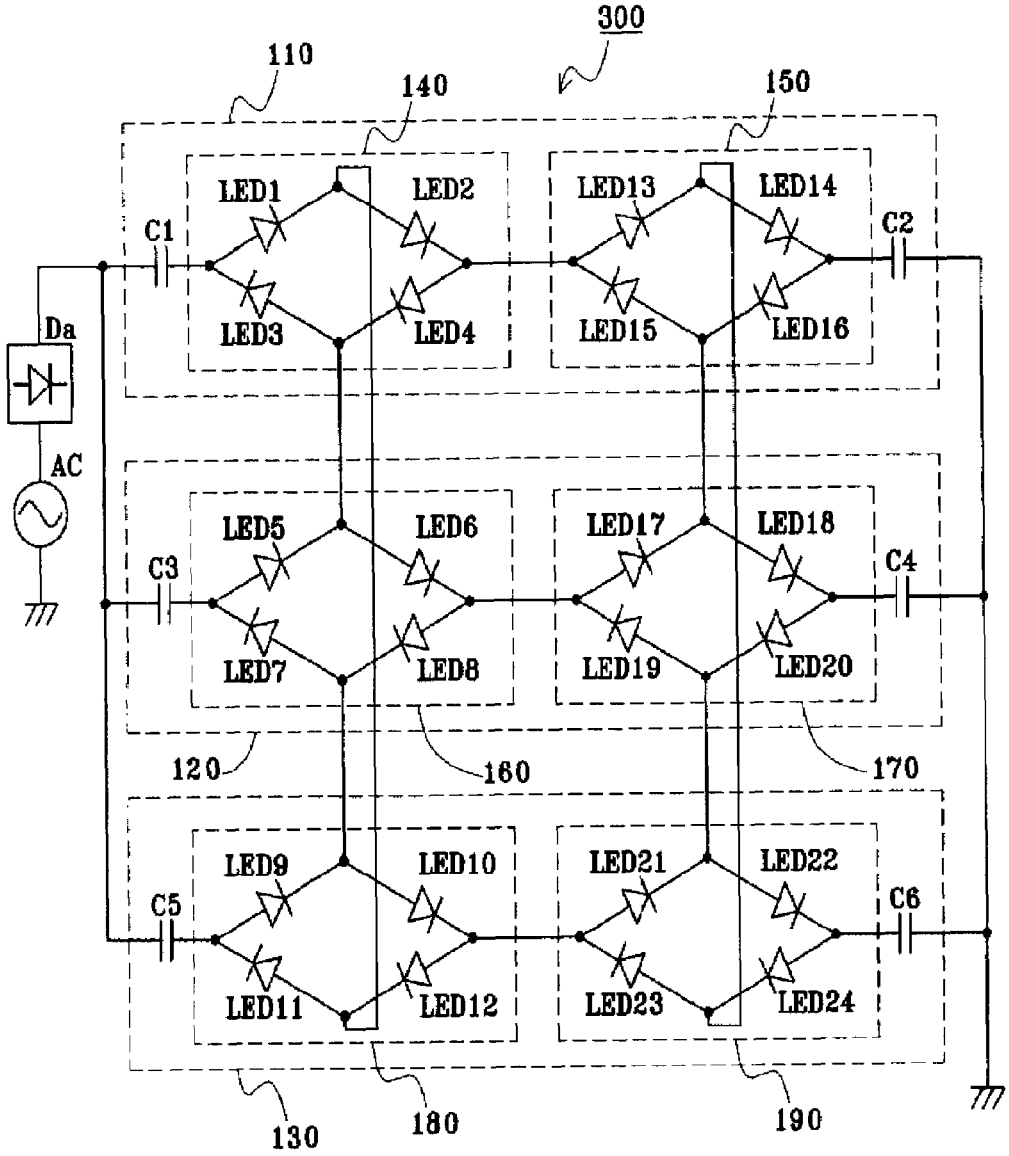
FIG. 3 is a circuit diagram showing an LED lighting device according to still another preferred embodiment of the present invention.

FIG. 3 shows a circuit of an LED lighting device according to a third preferred embodiment of the present invention. In FIG. 3, the same parts as in FIG. 1 are referred to as the same reference numerals, and the explanation of those same parts is omitted.

An LED lighting device 300 shown in FIG. 3 includes a full-wave rectifying circuit Da as well as the parts included in the LED lighting device 100. That is, the voltage of the AC power supply AC that has been subjected to a full-wave rectification is applied to the LED lighting device 300 having the same configuration as the LED lighting device 100.

In the LED lighting device 300, the voltage of the AC power supply AC that has been subjected to a full-wave rectification but that has not been smoothed is applied to the LED lighting device having the same configuration as the LED lighting device 100. The fundamental frequency of the voltage acquired by performing the full-wave rectification of the voltage of the AC power supply AC is twice the frequency of the AC power supply AC. Thus, at the frequency, the impedance of a capacitor is reduced to half, and the amount of voltage drop is reduced to half. In other words, if the capacitance of the capacitor is reduced to half, the impedance is increased to twice, thus achieving the same amount of voltage drop as the LED lighting device 100. Thus, in other words, by providing the full-wave rectifying circuit Da, the capacitances of the capacitors C1 and C2 can be reduced to half while the same amount of current flows to an LED. Generally, a capacitor having a smaller capacitance is less expensive. Thus, the cost of the LED lighting device 300 is less than that of the LED lighting device 100.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An LED lighting device comprising:

n number of LED arrays that are connected in parallel with each other and that have substantially the same internal configuration, where n is an integer number equal to at least two; wherein each of the LED arrays includes at least one capacitor and at least one LED block that are sequentially connected in series with each other;

each of the at least one LED block includes a first series circuit and a second series circuit that are connected in parallel with each other, the first series circuit including first and second LEDs that are connected in series with each other in the same direction, and the second series circuit including third and fourth LEDs that are connected in series with each other in a direction opposite to the direction of the LEDs in the first series circuit; and in LED blocks in a same sequential order in an ith LED array and an i+1th LED array, a connection point between the third and fourth LEDs in the ith LED array is coupled to a connection point between the first and second LEDs in the i+1th LED array, where i is an integer between 1 and n, and where the i+1th LED array is the first LED array when i is n.

2. The LED lighting device according to claim 1, wherein the LED arrays have a substantially cylindrical shape.

3. The LED lighting device according to claim 1, further comprising a full-wave rectifying circuit connected in series with the LED arrays that are connected in parallel with each other.

4. The LED lighting device according to claim 1, wherein n is three.

5. The LED lighting device according to claim 1, wherein, in each of the LED arrays, the at least one capacitor includes a first and a second capacitor, and the at least one LED block includes a first LED block and a second LED block.

6. The LED lighting device according to claim 1, wherein in each of the LED arrays, the first capacitor, the first LED block, the second LED block, and the second capacitor are connected in series in this order.

* * * * *